United States Patent [19]

Ueno

[11] 4,045,081

[45] Aug. 30, 1977

[54] RECLINING CHAIR

[75] Inventor: Kiyoshi Ueno, Kawasaki, Japan

[73] Assignee: NHK Spring Co., Ltd., Yokohama, Japan

[21] Appl. No.: 658,117

[22] Filed: Feb. 13, 1976

[30] Foreign Application Priority Data

June 24, 1975 Japan ..... 50-78409

[51] Int. Cl.[2] ..... A47C 1/02

[52] U.S. Cl. ..... 297/317; 297/68; 297/355

[58] Field of Search ..... 297/317, 375, 355, 440, 297/68

[56] References Cited

U.S. PATENT DOCUMENTS

| | | | |
|---|---|---|---|
| 2,091,063 | 8/1937 | Ball | 297/317 |
| 2,303,308 | 11/1942 | McArthur | 297/317 |
| 2,400,588 | 5/1946 | McArthur | 297/317 |
| 2,512,353 | 6/1950 | Magaldino et al. | 297/317 |
| 3,814,477 | 6/1974 | Mattisson | 297/440 |
| 3,874,480 | 4/1975 | Porter | 297/375 |
| 3,947,069 | 3/1976 | Lusch | 297/317 |

*Primary Examiner*—James T. McCall

[57] ABSTRACT

A reclining chair having a seat section slidably connected to a frame section. A rearward end portion of the seat section and a back-rest section are rockably and separably connected to a lower end portion of the back-rest section and to a rearward end portion of the frame section, respectively. A friction brake apparatus for non-stepwise controlling the sliding movement of the seat section is fitted to one side of the seat section, and through the brake apparatus the seat section is connected to the frame section by coupling means.

5 Claims, 7 Drawing Figures

RECLINING CHAIR

BACKGROUND OF THE INVENTION

This invention relates to a reclining chair, and more particularly to a reclining chair capable of adjusting a back-rest section non-stepwise.

A reclining chair whose back-rest section is rockably connected to a seat section or frame section through a latch mechanism is conventionally known. In this type of reclining chair, the latch mechanism has a number of notches and the back-rest section is fixed at a desired reclining position by causing the latch member to be selectively engaged with a corresponding desired one of the notches. Accordingly, the reclining position of such conventional reclining chair is limited by the number of notches provided, which makes it impossible to set the reclining position non-stepwise. Further, in such reclining chair, the latch mechanism is generally made complicated in construction and in spite thereof is weak in fixing force to present difficulties in maintaining the reclining position reliably.

A reclining chair using a screw or gear mechanism is also conventionally known. Though, in this type of reclining chair, the reclining position can be determined substantially non-stepwise, the positioning operation is very troublesome. In addition, this reclining chair has another drawback that the screw or gear mechanism is complicated in construction and bulky.

Further, in the conventional reclining chair, a reclining position adjusting mechanism such as the latch mechanism and screw or gear mechanism is disposed generally in the proximity of a connected section between the back-rest section and another adjacent section. Accordingly, difficulties are presented in dismembering the reclining chair into constituent sections. Since, therefore, the chair becomes bulky upon transport, an inconvenience results.

SUMMARY OF THE INVENTION

The object of the invention is to provide a reclining chair capable of easily and non-stepwise setting the reclining position and being readily dismembered and assembled.

For achieving the above object, according to a preferred embodiment of the invention, a reclining chair has a seat section slidably and separably connected to a frame section. On one side of the seat section, a friction brake apparatus for non-stepwise controlling the sliding movement of the seat section (as such friction brake apparatus there is a mechanism disclosed in U.S. Pat. No. 3,874,480 issued Apr. 1, 1975 to C. R. Porter et al) is fitted, and the seat section and frame section are connected through said brake apparatus to each other. A rearward end portion of the seat section and a back-rest section are rockably and separably connected to a lower end portion of the back-rest section and to a rearward end portion of the frame section, respectively. Since the reclining chair of the invention has the foregoing construction, the sliding movement of the seat section causes the back-rest section to be rocked about a connected point between the back-rest section and the frame section. Through fixing the slided position of the seat section by the friction brake apparatus, the reclining position can be set reliably and non-stepwise. Further, in the reclining chair of the invention, the friction brake apparatus is fitted on one side of the seat section and said three sections are independently constructed and mutually separably connected to each other. Therefore, the reclining chair can not only be easily dismembered and assembled but also packed up into a compact package.

The above and further objects and novel feature of the invention will more fully appear from the following detailed description when the same is read in connection with the accompanying drawings. It is to be expressly understood, however, that the drawings are for purpose of illustration only and is not intended as a definition of the limits of the invention.

DETAILED DESCRIPTION OF THE PREFERRED EMBODIMENT

Figure 1:
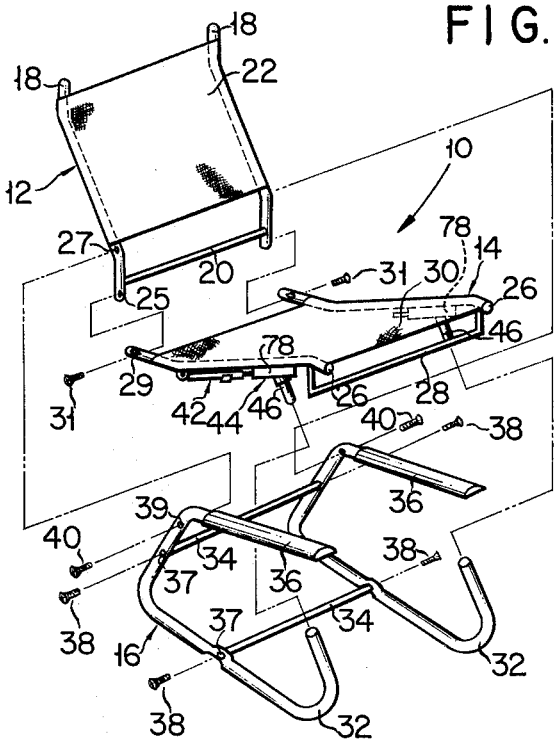
FIG. 1 is a perspective dismembered view of a reclining chair according to an embodiment of the invention, showing the connection relationship among sections.
Figure 2A:
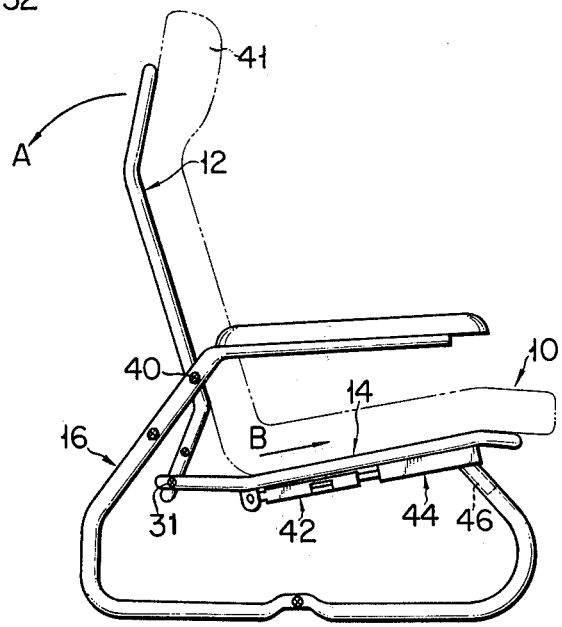
FIGS. 2*a* and 2*b* are side views showing the upright position and the reclining position of the assembled reclining chair, respectively.
Figure 2B:
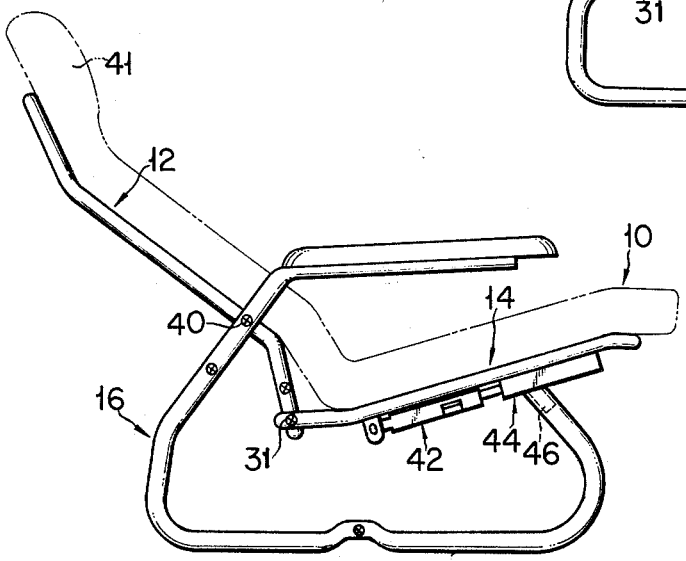

In FIG. 1 showing an embodiment of the invention, a reclining chair 10 comprises a back-rest section 12, seat section 14, and frame section 16 which are constructed mutually independently.

The back-rest section 12 comprises a pair of pipe-like side members 18, a connecting rod 20 for connecting together the lower end portions of the side members 18, and a cushion 22 stretched between the side members 18 such as that made of nylon or cotton fabric material. Since both ends of the connecting rod 20 are welded to the side members 18, respectively, the side members 18 are mutually connected at a desired distance from each other. Reference numerals 25, 27 denote smoothed blind holes bored, respectively, in the side members 18 from outside so as to be utilized when the back-rest section 12 is connected to each of the seat section 14 and frame section 16. T-shaped nuts (not shown) are welded to the holes 25, 27.

The seat section 14 comprises, similarly to the back-rest section 12, a pair of pipe-like side members 26, a bent connecting rod 28 for connecting the side members 26, and a cushion 30 stretched between the side members 26 such as that made of nylon or cotton fabric material. Rearward end portions of the side members 26 are bored with smoothed through holes 29, respectively. Accordingly, through fitting, by screw engagement, bolts 31 such as cross-recessed head screws to the T-shaped nuts through the through holes 29 and the holes 25 of the side members 18 of the back-rest section 12, the back-rest section 12 is rockably and separably connected to the seat section 14. The bent connecting rod 28 is fitted between the side members 26 similarly to the connecting rod 20.

The frame section 16 comprises a pair of pipe-like, substantially trapezoidal base frames 32, and a pair of connecting rods 34 for connecting the base frames 32, and a pair of arm-rest 36 are disposed on the base frames 32, respectively. A pair of nuts (not shown) are fixed to both ends of each connecting rod 34, respectively. Through fitting, by screw engagement, a pair of bolts 38 to the pair of nuts, respectively, through a pair of smoothed through holes 37 bored, respectively, in the base frames 32, the connecting rods 34 connect the base frames 32. Rearward end portions of the base frames 32 are bored with another pair of smoothed through holes 39. Through fitting, by screw engagement, a pair of bolts 40 to a pair of nuts (not shown) through the through holes 39 and the blind holes 27 to the side members 18 of the back-rest section 12, respectively, the back-rest section 12 is rockably and separably connected to the frame section 16.

A friction brake apparatus 42 for non-stepwise adjusting the reclining position of the back-rest section 12 by restricting the sliding movement of the seat section 14 relative to the frame section 16 is attached through a coupling means 44 to one side member 26 of the seat section 14. Through inserting a pair of connectors 46 of the coupling means 44 into the tip ends of the risen portions of the side frames 32 of the frame section 16, the seat section 14 is separably connected to the frame section 16.

FIGS. *2a* and *2b* each show the condition wherein the independently constructed three sections 12, 14 and 16 are connected together. When, in FIG. *2a*, the back-rest section 12 is rocked in an arrow A-indicated direction about a rocking point 40 between the back-rest section 12 and the frame section 16, the seat section 14 is allowed to slide in an arrow B-indicated direction thus to be brought to such a reclining position as shown in FIG. *2b*. It will be appreciated, therefore, that through rocking the back-rest section 12 in the opposite direction to the arrow A-indicated direction by causing the seat section 14 to slide in the opposite direction to the arrow B-indicated direction, the back-rest section 12 can be returned to an upright position shown in FIG. *2a*. Note that if, in case the reclining chair 10 is used actually, a jeans-made mattress 41 filled with, for example, urethane chip is disposed as shown, the user can make himself more at home.

Figure 3:
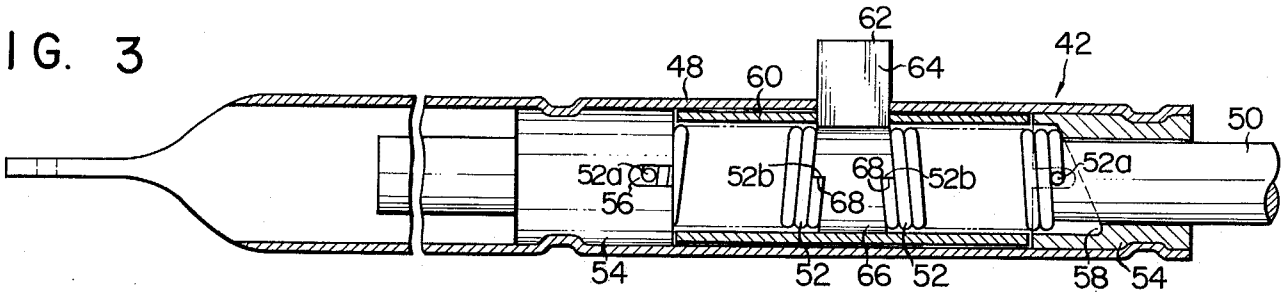
FIG. 3 is a longitudinal sectional view of the friction brake apparatus.

The friction brake apparatus 42 for restricting the sliding movement of the seat section 14 in order to obtain a desired reclining position, as shown in FIG. 3, comprises a pipe-like housing 48, a shaft 50 extending through the housing 48, and a pair of coil springs 52 fitted over the shaft 50 and differring from each other in respect of twisted or torsional direction. The torsion coil springs 52 have such an inner diameter as is capable of locking the shaft 50 and each grip the shaft 50 in a usually twisted condition. A pair of bushings 54 are symmetrically fixedly attached to the housing 48 so as to cause the springs 52 to be disposed therebetween, as shown. A pair of engaging slits 56 for preventing the springs 52 from being rocked about the axex thereof and engaging those distal bent coil ends **52*a* of the end portions of the springs 52 which are faced to the bushings 54, so as to permit the springs to slide axially are provided for the walls of the bushings 54 in a manner penetrating therethrough. The inner walls of the bushings 54 are each stepped, and their respective shoulders 58 are each so formed as to have a larger angle of inclination than the helical angle of the springs 52. Though, in FIG. 3, for a better understanding, the right bushing 54 only is shown sectionally, both of the bushings 54 have of course symmetrically the same configuration. A split sleeve 60 is idly received within the housing 48 in a manner adjacent to the springs 52. An operating lever 62 having a plate portion 64 exteriorly extended through a split of the sleeve 60 and a ring portion 66 rockably fitted over the shaft 50 between the springs 52 is further received within the housing 48. Further, a pair of notches 68 abutting, respectively, on mutually opposing distal coil ends 52*b* of other end portions of the springs 52 are symmetrically formed in the ring portion of 66 the operating lever 62**.

Since the friction brake apparatus 42 has the foregoing construction, the shaft 50 is locked due to a frictional force of the coil springs 52 when the lever 62 is rendered inoperative. If, however, the extended plate portion 64 of the operating lever 62 is manually pulled toward the user thereby causing the ring portion 66 to be rocked about the axis thereof against the torsional force of the spring 52, the distal coil ends **52*b* of the springs 52 abutting on the notches 68 are pressed but, since the distal bent coil ends 52*a* of the springs 52 are fixed to the engaging slits 56 of the bushings 54, the springs 52 are twisted back to cause the inner diameter thereof to be substantially enlarged. As a result, the springs 52 fail to lock the shaft 50 utilizing their frictional force, which accordingly permits the shaft 50 to slide freely in the axial direction. The operating lever 62 is returned to the original position due to the torsional force of the spring 52 if the manually given rocking force is released. Further, since the sleeve 60 is fitted within the housing 48 in a manner adjacent to the springs 52, the springs 52 are uniformly twisted back without being locally twisted back. Therefore, a highly reliable release operation is obtained. Since the inclined shoulder 58 are formed on the inner walls of the bushings 54, if an axial force causing the shaft 50 compulsively to slide acts on the shaft 50 at the time of locking the same, said bent tip ends 52*a* of the coil springs 52 faced to the bushings 54 are allowed to slide within the engaging slits 56 toward the inclined shoulder portion 58, thereby increasing the helical angle of the springs 52. Accordingly, a frictional force of the springs 52 applied to the shaft 50 is also increased, and the larger said axial force is, the more firmly the shaft 50 is locked. The paired springs 52 and bushings 54 are respectively symmetrically disposed and therefore, even when the shaft 50** receives said axial force in any of both axial directions, such frictional force is produced.

Figure 4:
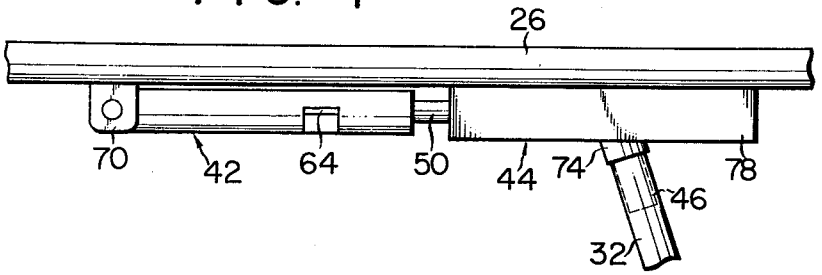
FIG. 4 is a schematic view showing the connection relationship between the seat and frame sections.
Figure 5B:
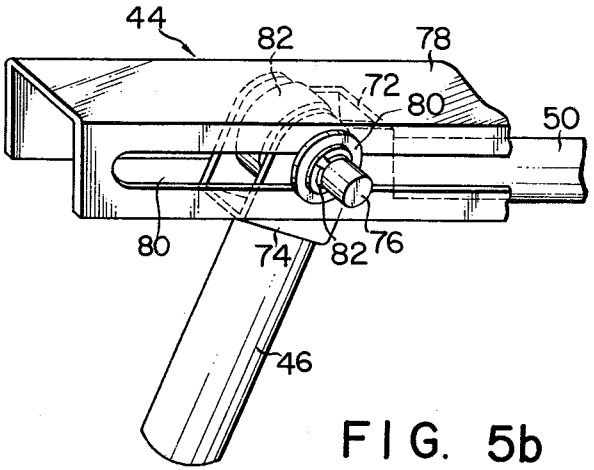
FIG. 5*b* is a perspective view similar to FIG. 5*a*, taken from the opposite side to that of FIG. 5*a*.
Figure 5A:
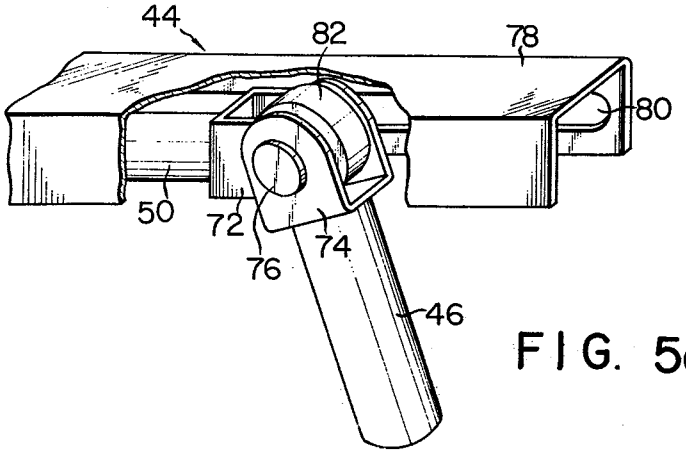
FIG. 5*a* is a perspective view, partly broken away, of the connected portion between the seat and frame sections

One end of the pipe-like housing 48 is formed into a flat plate-like configuration, and, as shown in FIG. 4, this flat closed end is pivotally supported by a pin on a fittings 70 fixed to the side member 26 of the seat section 14. The shaft 50 extended from the housing 48 is slidably held by the coupling means 44.

Yokes 72 and 74 are fitted to the projected end of the shaft 50 and the connector 46 of the coupling means 44, respectively. The yokes 72, 74 are rockably connected to each other by a pin 76. A guide 78 is secured to the underside of each side member 26 of the seat section 14, and receives therein said pin 76. The guide 78 has a reversed U-shaped cross section and the inner side wall thereof is formed with a guide slot 80. The pin 76 is slidably projected through the guide slot 80, and the projected end of the pin 76 is fitted with a washer member 80 for preventing the pin 76 from falling off from the guide 78, and an E-shaped clip ring 82 for fixing the washer member 80. A roller 82 is fitted to the pin 76 so as to slidably abut against the upper wall of the guide 78.

As seen from FIG. 1, the guide 78 is fixed to each of the side members 26 of the seat section 14, and the friction brake apparatus 42 is fitted only to one side member 26. But both side members 26 have the same construction excepting that the other side member has no friction brake apparatus 42 and yoke 72. Since a right-handed person is much larger in number, the friction brake apparatus 42 is generally fitted to the right side member 26 as shown.

As above described, the seat section 14 is connected to the frame section 16 by the coupling means 44 through the friction brake apparatus 42. Accordingly, if the back-rest section 12 is rocked, the guides 78 of the side members 26 are allowed to slide on the fixed pin 76, and the seat section 14 can be freely moved back and forth. Further, since the roller 82 of the pin 76 is allowed to abut against the upper wall of the guide 78, the seat section 14 is moved reliably and smoothly.

In the reclining chair according to the invention, with the spring 52 released by rocking the operating lever 62 against the bias force of the springs 52, the back-rest section 12 is rocked to any desired position and then the operating lever 62 is released, thereby to easily reliably determine the reclining position non-stepwise.

The reclining chair according to the invention can be easily dismounted into said three sections 12, 14 and 16 and simultaneously each section can also be dismembered into the constituent members. Therefore, the reclining chair can be packed up into a compact package. But, if, for example, the cushions 22 and 30 are integrally made of a single piece of clothing; and the back-rest section 12 and seat section 14 are assembled in advance and rockably connected together by means of the bolts 31 and folded; and simultaneously the base frames 32 of the frame section 16 are dismembered from each other, whereby the reclining chair is packed up, the reclining chair can be assembled quickly. Further, since the side members 18, 26 and 32 are formed into a pipe-like configuration, the reclining seat easy to fabricate and excellent in terms of design can be mass-produced.

This invention is not limited to the above-mentioned embodiment, but can be applied in various modifications without departing from the objects and scope of the invention.

What is claimed is:

1. A reclining chair comprising: a seat section having a front end and a rear end, a back-rest section having a lower end rockably and separably connected to the rear end of said seat section; a frame section rockably and separably connected to said back-rest section and including a pair of mutually separably connected side frames and an upwardly extending portion; a friction brake apparatus tilted to one side of said seat section and including a housing, a slidable shaft having one end extended through said housing, a pair of coil springs differing in twisted direction from each other and fitted over said shaft so as to grip said shaft thereby to lock said shaft by frictional force between said coil springs and said shaft, release means rockably fitted over said shaft between said coil springs in a manner allowed to abut on the distal coil ends of mutually opposing end portions of said coil springs and so designed that when said release means has been rocked, said coil springs are twisted back to unlock said shaft, sleeve means received within said housing adjacent to said coil springs so as to cause respective coils of said coil springs to be twisted back uniformly, and bushing means fixed within said housing and having a pair of engaging means engaged with the distal bent coil ends of the other end portions of said coil springs, respectively, so as to prevent them from being rocked, and a pair of inclined shoulders each having a larger angle of inclination than the helical angle of said coil springs and abutting on the distal coil end of said other end portions of said coil springs, respectively; and coupling means for slidably coupling said seat section to said frame section through said brake apparatus, said coupling means including a fitting for fitting said housing of said brake apparatus to said seat section and a coupling mechanism for fixedly coupling an extended end portion of said shaft of said brake apparatus to said frame section, said coupling means including a connector separably fitted into said upwardly extending portion thereby slidably coupling said seat section to said frame section.

2. A reclining chair according to claim 1, wherein said coupling mechanism of said coupling means further includes a pin for pivotally joining said connector to said extended end of said shaft, and a reversed U-shaped guide member fixed to said seat section and having one axial slit formed in an inner wall of said guide member so as to slidably support and guide an extended end of said pivot pin.

3. A reclining chair according to claim 2, wherein said coupling mechanism of said coupling means further comprises a rockable roller mounted on said pivot pin and received within said guide member so as to abut on an upper wall of said guide member, and a separable clip ring fitting and end portion of said pivot pin extending from said guide slit to said guide slit to prevent said end portion of said pivot pin from falling off from said guide slit.

4. A reclining chair according to claim 3, wherein yokes respectively connect said connector and said extended end of said shaft to said pivot pin.

5. A reclining chair according to claim 4, wherein said seat section further includes a pair of side members, a cushion stretched between said side members and a bent connecting rod for connecting said side members at a point apart from said upwardly extending position of each of side members, said connecting rod being bent so as not to touch said cushion when subjected to a person's weight.

* * * * *